US007162819B1

(12) United States Patent
Johnson

(10) Patent No.: US 7,162,819 B1
(45) Date of Patent: Jan. 16, 2007

(54) IRONING BOARD ATTACHMENT APPARATUS

(76) Inventor: Janice M. Johnson, 2015 N. Adams, Hutchinson, KS (US) 67502

( * ) Notice: Subject to any disclaimer, the term of this patent is extended or adjusted under 35 U.S.C. 154(b) by 199 days.

(21) Appl. No.: 10/746,101

(22) Filed: Dec. 26, 2003

(51) Int. Cl.
*D06F 81/02* (2006.01)
*D06F 71/40* (2006.01)

(52) U.S. Cl. ..... 38/111; 38/137

(58) Field of Classification Search ..... 38/103, 38/104, 106, 107, 111, 137, DIG. 2; D32/66; 108/28, 29, 64, 65, 91; 211/86.01, 123; 248/175; 269/289 R
See application file for complete search history.

(56) References Cited

U.S. PATENT DOCUMENTS

| | | | | | |
|---|---|---|---|---|---|
| 1,016,848 | A | * | 2/1912 | North | 38/106 |
| 1,017,842 | A | | 2/1912 | Baker | |
| 1,191,782 | A | | 7/1916 | Harrison | |
| 2,165,548 | A | * | 7/1939 | Hipp | 38/106 |
| 2,236,717 | A | * | 4/1941 | Noack | 248/240.4 |
| 2,554,983 | A | * | 5/1951 | Hedges | 38/106 |
| 2,637,918 | A | * | 5/1953 | Mayhew | 38/111 |
| 2,707,841 | A | * | 5/1955 | Figura | 38/111 |
| 2,723,097 | A | * | 11/1955 | Tyler | 108/28 |
| 2,729,005 | A | * | 1/1956 | Foster | 38/139 |
| 2,869,259 | A | | 1/1959 | Hipp | |
| 3,443,328 | A | * | 5/1969 | Williams | 38/104 |
| 3,565,414 | A | * | 2/1971 | Carlson | 269/16 |
| 4,702,381 | A | * | 10/1987 | Carter et al. | 211/105.2 |
| 5,984,839 | A | * | 11/1999 | Corkum | 482/54 |
| 6,014,827 | A | * | 1/2000 | Lehrman | 38/104 |

* cited by examiner

*Primary Examiner*—Ismael Izaguirre

(57) ABSTRACT

Ironing board attachment apparatus for use on conventional ironing boards comprising a laterally movable extension arm positioned adjacent one side of the ironing board which can move laterally towards or away from the board, the arm comprising an arcuate surface in cross-section for support of fabric being ironed. The extension arm being supported by a mounting bracket supporting the extension arm in a cantilevered manner to the ironing board and a pair of shoulder arms, one positioned on each side of the ironing board in juxtaposed relation to the sides of the board; the shoulder arms including a radius portion in cross-section similar to the extension arm and a bracket for each shoulder arm mountable on the ironing board sides permitting sliding longitudinal movement of each shoulder arm.

7 Claims, 3 Drawing Sheets

IRONING BOARD ATTACHMENT APPARATUS

BACKGROUND OF THE INVENTION

The present invention relates to an ironing board and more particularly, to attachment apparatus which assists the ironer in holding the items being ironed in place and preventing creasing after ironing.

Ironing boards are well known in the art and widely used and in virtually all households, as well as in commercial laundries. The top surface of the board is used as the platform on which a multitude of garments, linens and other wrinkled textiles are ironed.

In the prior art there have been a variety of various ironing board attachments, which have various functions. As for example, U.S. Pat. No. 2,869,259 provides a pair of parallel arms, which support a looped apron between the arms to prevent ironed material from being soiled by contact with the floor.

U.S. Pat. No. 1,191,782 provides an adjustably positioned rod for supporting a portion of the clothing being ironed which overhangs the edges of the board to prevent the ironed material from contacting the floor. This patent also teaches a second cantilevered-mounted rod 13 for a similar use as stated above.

U.S. Pat. No. 1,017,842 teaches a similar parallel rod structure for supporting clothing.

U.S. Pat. No. 2,554,983 teaches a pair of parallel rods positioned adjacent the edge of the ironing board at varying heights and varying distances from the board. These supporting members are likewise used to support ironing material having considerable length such as sheets, curtains, tablecloths, and the like whereby the un-ironed portions as well as the ironed portions are prevented from coming in contact with the floor and becoming soiled.

U.S. Pat. No. 6,014,827 also teaches a series of parallel rods, but within a rack which rack slides laterally outward from under the ironing board for multiple purposes such as a drying rack or for supporting ironed shirts on hangers.

SUMMARY OF THE INVENTION

One of the primary aspects of the present invention is to prevent creasing of ironed fabrics while drying, thereby avoiding re-ironing to remove the creases caused by the edges of all conventional ironing boards. Immediately after a fabric is ironed with steam, it contains sufficient moisture whereby the portions of the fabric falling across the edges of a conventional board acquire creases which are far less probable after the fabric is air-dried. This air drying is also referred to as allowing the ironed fabric to rest so that the press holds or sets which takes 10 to 15 seconds depending on the material. This creasing problem is solved through the use of large radius surfaces both on the side edges of the board as well as a cantilevered extension rod which extends outwardly from the board to support the freshly ironed fabric.

Another aspect of the present invention is to provide means for holding and supporting items or fabrics being ironed thereby allowing the person ironing better use of their free hand for working or smoothing the fabric in position for ironing. The extension arm also has the same function as the above-mentioned prior art in holding the large items being ironed off the floor both before and after ironing.

Conventional ironing boards include a tapered section for ironing clothing while the wider straight section of the ironing board is utilized for flat work in addition to clothing. Since it is not practical for a majority of people to have more than one ironing board, the conventional board has limited length when it comes to ironing wide flat work. With the present invention, when the pair of shoulders are positioned fully forward, the tapered section of the board becomes an effective straight section for practically the full length of the board. This ability to use most of the ironing board surface allows you to do a single fold of a wide item, therefore requiring a single pass of the iron rather than a double fold with four surfaces that must reverse the folds and iron again which much increases the ironing time. This effectively provides a variable shape ironing board which can iron both clothing on the tapered section and fuller width flat work, all on the same board.

The present invention has an additional function in that it squares the ironing board with respect to the fabric being pressed. It aids in the squaring of fabric on its approach to and descent from the ironing board. A seamstress pre-launders fabric to preshrink the fabric then irons the fabric with a creased fold. This fold line must be square to the weave to achieve a straight grain, which enables the garment to hang properly when worn. A pattern piece, such as a shirt back, is placed on the edge of this fold line to make efficient use of the cutting layout. If the fabric is wide enough that it drapes over the tapered end of the ironing board, it tends to make this process more difficult. The shoulder arm aids this process in keeping fabric square.

Therefore, the principal object of the present invention is to provide an ironing board, which does not crease the hanging edge of freshly ironed fabric. Another object of the present invention is to convert a conventional ironing board into a full-length straight-sided board for wide flat work.

Another object of the present invention is to provide ironing board attachments that support and retain a garment or a large item in place, thereby freeing up the free hand to maneuver the fabric across the board as the ironing progresses.

A further object is to provide an ironing board with a support surface allowing side entry and departure of the material.

A further object is to assist in squaring the fold for seamstress work.

DETAILED DESCRIPTION OF THE PRESENT INVENTION

Figure 1:
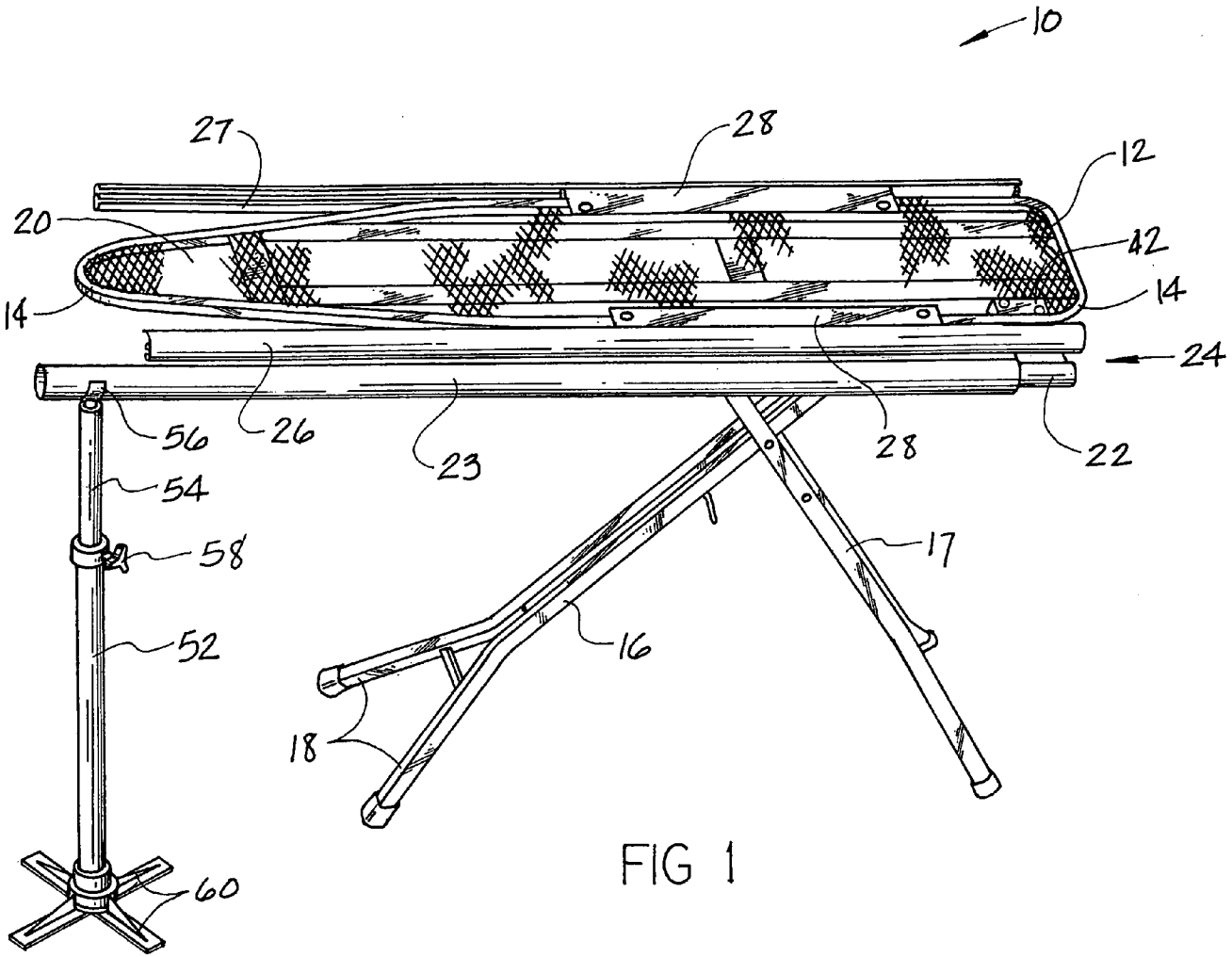
FIG. 1 is an isometric view of the ironing board attachment apparatus of the present invention with the movable support post supporting the free end of the extension arm extender tube.

The ironing board attachment apparatus of the present invention and the ironing board are generally recognized by reference numeral 10. The ironing board itself is of conventional design including an expanded metal top surface 12 surrounded by a u-shaped cross-section frame 14. The board 10 is supported by conventional pivoting legs 16 and 17, each having a pair of feet 18, all of which is very well known in the art and, therefore, not described in detail.

Figures 3, 4, 5:
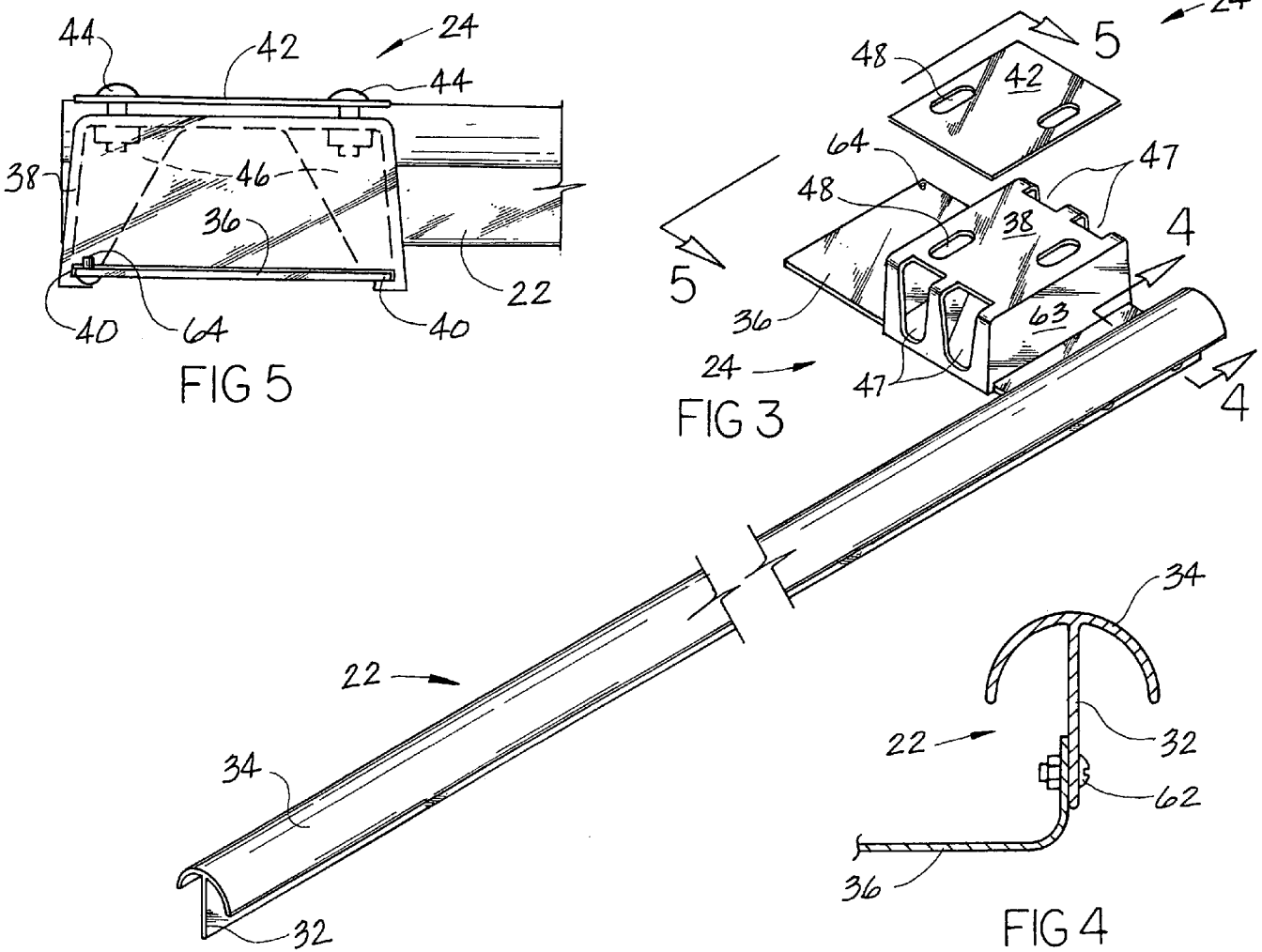
FIG. 3 is an isometric view of the extension arm and its mounting bracket with portions of the arm broken away.
FIG. 4 is a sectional view to an enlarged scale taken along lines 4—4 of FIG. 3.
FIG. 5 is an elevational view of the support bracket taken along lines 5—5 of FIG. 3 in its assembled position; and, FIG. 6 is a sectional view to an enlarged scale taken along lines 6—6 of FIG. 2.

Attached to one side of the ironing board 10, in parallel relation, is an extension arm 22 which is mounted to the board in a cantilevered fashion through a mounting bracket 24, shown in detail in FIGS. 3 and 5.

Figure 2:
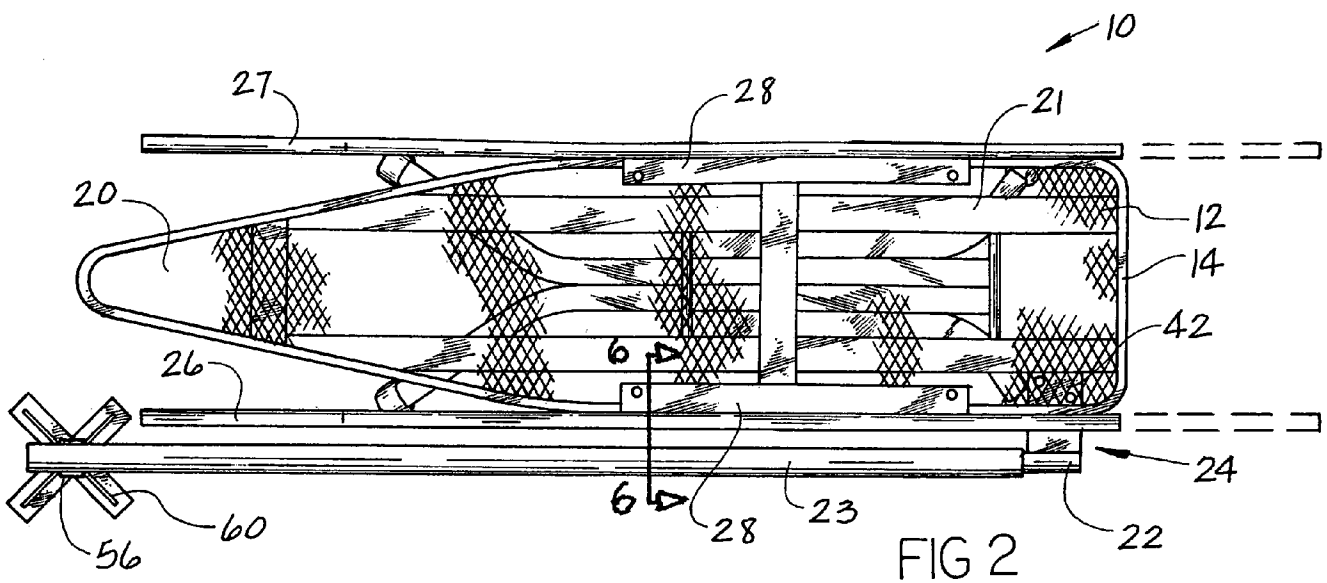
FIG. 2 is a top plan view of the present invention with the shoulder arms shown in their fully forward position and in dotted line at their rearward position.
Figure 6:
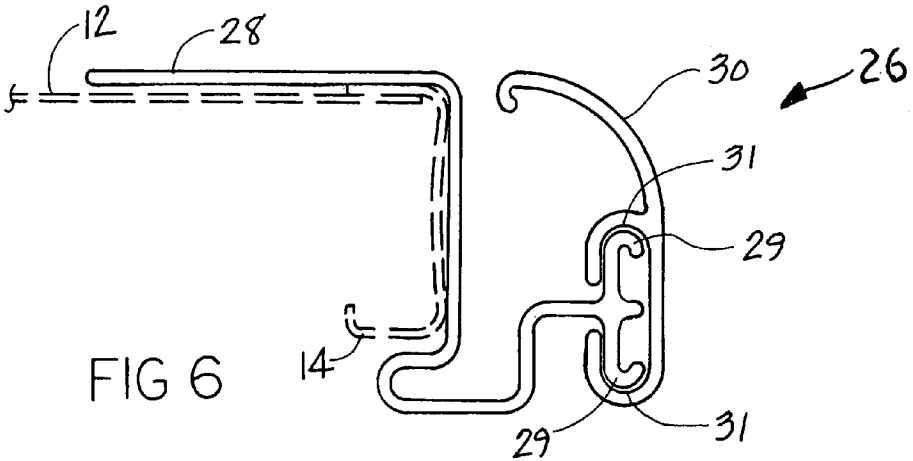

Attached to both sides of the ironing board 10, as best seen in FIG. 2, are identical shoulder arms 26 and 27. The shoulder arms are each mounted on a stationary bracket 28 which permits the shoulder arms to slide longitudinally along the edge of the ironing board along a rail 29 having two convex surfaces as seen in FIG. 6. The shoulder arms 26 and 27 are formed by extrusions and include a pair of facing grooves 31 which ride along previously mentioned rail 29 permitting the shoulder arm to move forward on the board to the full line position shown in FIG. 2 and then rearwardly on the board 10 as shown in dotted line. Shoulder arms 26 and 27 include an arcuate surface 30, the upper end of which is tangent with the top surface 12 of the ironing board. A garment or fabric being ironed will hang downward across radius 30 so as to prevent creasing after the material is ironed.

Extension arm 22 is formed as an extrusion having a vertical web 32 which joins a semi-circular arcuate portion 34 having a similar radius to that on shoulder arm 26. Arm 22 is attached to plate 36 as shown in FIGS. 3 and 4. Plate 36 is slideably received in bracket 24 in a pair of facing grooves 40 as best seen in FIG. 5. Plate 36 moves from its retracted position as shown in FIG. 3, laterally outward from the ironing board 10 to its extended position which is limited by rivet 64 when it engages bracket 24. Bracket 24 is injection molded in a box-like shape having end walls 63, inner-strengthening webs 46, side openings 47, and mounting openings 48 in the top surface 38 of bracket 24. The mounting bracket 24 engages the expanded metal surface 12 of the ironing board between the bracket 24 and a flat plate 42 held in place by bolts 44 as seen in FIG. 5. The cantilevered mounting of extension arm 22 permits loading and unloading of material on the left end of extension arm 22 as shown in FIG. 3. Extension arm 22 also includes an extension tube 23 as shown in FIGS. 1 and 2 which telescopingly passes over extension arm 22 so as to provide a longer support surface for ironing fabric wider than the length of the ironing board. With the use of an extension tube 23 its necessary to provide a moveable support post 52 as best shown in FIG. 1. Post 52 includes a telescoping extension tube 54 which can be held in place by a conventional frictional lock screw 58 which can be adjusted for various heights. The support post includes a saddle 56 for supporting the extension tube 23 and a series of four support feet 60.

The shoulder arm brackets 28 fit over the exterior surface of frame 14 of the ironing board and are bolted to the expanded metal top surface 12 as seen in FIG. 6.

Operation

Conventional ironing boards, as exemplified in FIGS. 1 and 2, include a straight portion of the board 21 and a tapered portion 22 at the left end. The tapered portion is used to iron various items of clothing while the straight section is typically used to iron flat work such as table cloths and bed linens. With the use of shoulder arms 26, as seen in FIG. 2, the length of the straight portion of the board is extended to the full length which allows you to do a single fold of a very wide item, thereby requiring only a single pass of the iron. Otherwise, one would need a double fold with four layers of material what would require a refold and multiple ironings.

When only the tapered end of the board is in use, the shoulder arms 26 can be used in their FIG. 1 position to support the ironed portions to prevent creasing or they can be slid to the right, as seen in dotted line in the drawing, so as to open up the tapered end of the board. Also, one can iron on one side while using one shoulder arm on the opposite side to support and permit the ironed garment or fabric to dry without creasing. While ironing very long flat work, the extension arm 22 can be pulled outward from the board thus allowing the ironed material to drape over the extension arm 22 and dry while preventing contact with the floor. The present invention functions in the absence of either one of the extension arm 22 or the shoulder arms 26 and 27 or with the inclusion of both as seen in the drawings.

It will be appreciated by those skilled in the art that changes could be made to the embodiments described above without departing from the broad invented concepts of preventing board edge creasing and support of the fabric while being ironed. It is understood, therefore, that this invention is not limited to the particular embodiments disclosed, but is intended to cover modifications within the spirit and scope of the present invention as defined by the claims.

I claim:

1. Ironing board attachment apparatus for use on an ironing board having ends, a tapered portion, a straight portion and longitudinal sides, the apparatus comprising:

a pair of shoulder arms, one positioned on each side of the ironing board in juxtaposed relation to the sides of the ironing board, the shoulder arms including a channel portion and a radius portion in cross-section, the radius portion being substantially tangent to the top surface of the ironing board;

a pair of brackets each mountable on the straight portion of each side of the ironing board, the bracket including a longitudinal rail along its length for receipt in the channel of the shoulder arm, thereby permitting sliding longitudinal movement of each shoulder arm between the tapered portion and straight portion of the board.

2. Ironing board attachment apparatus as set forth in claim 1, wherein the radius portion is between ½ inch and ¾ of an inch.

3. Ironing board attachment apparatus as set forth in claim 2 including a pair of shoulder arms, one mounted on each side adjacent the sides of the straight portion, the shoulder arms in cross-section having a substantially similar radius to that of the extension arm.

4. Ironing board attachment apparatus as set forth in claim 2 including a pair of shoulder arms, one mounted on each side adjacent the sides of the straight portion in sliding longitudinal movement along the sides of the straight portion, the shoulder arms in cross-section having a substantially similar radius to that of the extension arm.

5. Ironing board attachment apparatus as set forth in claim 2 including an extension member attached to the extension arm for extending the length of the extension arm and a separate support post for supporting one end of the extension arm.

6. An ironing board having a top surface, two sides, a tapered portion and a straight portion;

an extension arm positioned parallel to one of the sides of the board, the extension arm having an arcuate surface in cross-section tangent to the plane of the top surface;

a member attached to the extension arm extending laterally therefrom;

a mounting bracket attached to the straight portion including a channel portion positioned laterally from the board for slidable receipt of said member allowing it to slide toward or away from the board.

7. Ironing board attachment apparatus as set forth in claim 1, wherein the radius portion of the shoulder arm has a radius greater than ½ inch.

* * * * *